US012352281B2

(12) United States Patent
Lavagna et al.

(10) Patent No.: US 12,352,281 B2
(45) Date of Patent: Jul. 8, 2025

(54) CENTRIFUGAL SLURRY PUMP IMPELLER SHROUD WITH LIP

(71) Applicant: Weir Minerals Australia Ltd, Artarmon (AU)

(72) Inventors: Luis Moscoso Lavagna, North Ryde (AU); Garry Bruce Glaves, Eastwood (AU); Adrian Lionel Bois, Pymble (AU)

(73) Assignee: Weir Minerals Australia Ltd. (AU)

( * ) Notice: Subject to any disclaimer, the term of this patent is extended or adjusted under 35 U.S.C. 154(b) by 69 days.

(21) Appl. No.: 18/565,695

(22) PCT Filed: Jun. 24, 2022

(86) PCT No.: PCT/AU2022/050650
§ 371 (c)(1),
(2) Date: Nov. 30, 2023

(87) PCT Pub. No.: WO2022/266721
PCT Pub. Date: Dec. 29, 2022

(65) Prior Publication Data

US 2024/0254999 A1 Aug. 1, 2024

(30) Foreign Application Priority Data

Jun. 25, 2021 (AU) ..... 2021901936

(51) Int. Cl.
*F04D 29/22* (2006.01)
*F04D 1/00* (2006.01)
*F04D 7/04* (2006.01)

(52) U.S. Cl.
CPC ..... *F04D 29/2216* (2013.01); *F04D 1/00* (2013.01); *F04D 29/2272* (2013.01); *F04D 7/04* (2013.01)

(58) Field of Classification Search
CPC ... F04D 1/00; F04D 7/04; F04D 29/22; F04D 29/2205; F04D 29/2216
See application file for complete search history.

(56) References Cited

U.S. PATENT DOCUMENTS

| | | | | |
|---|---|---|---|---|
| 3,261,162 | A | 7/1966 | Coanda | |
| 2018/0135500 | A1 | 5/2018 | Won | |
| 2024/0254999 | A1* | 8/2024 | Lavagna | F04D 29/2294 |

FOREIGN PATENT DOCUMENTS

| | | | |
|---|---|---|---|
| CN | 113339269 | A | 9/2021 |
| GB | 658843 | A | 10/1951 |
| WO | 2010041565 | A1 | 4/2010 |

* cited by examiner

*Primary Examiner* — Christopher R Legendre
(74) *Attorney, Agent, or Firm* — Morriss O'Bryant Compagni Cannon, PLLC.

(57) ABSTRACT

A centrifugal slurry pump impeller including: a back shroud with opposed inner and outer faces and an outer peripheral edge, a central axis, a plurality of pumping vanes extending from the inner main face of the back shroud, the pumping vanes being disposed in spaced apart relation, each pumping vane including opposed main side faces, a leading edge in the region of the central axis and a trailing edge in the region of the outer peripheral edge of the back shroud with passageways between adjacent pumping vanes, wherein the inner main face of the back shroud along the length of the passageways, leading from the leading edge to the trailing edge, includes a generally planar inner region beginning adjacent the leading edge of the plurality of pumping vanes, and an outer region ending at the outer peripheral edge of the back shroud, wherein the outer region of the inner face of the back shroud includes a lip formation with an apex including a convex surface.

19 Claims, 8 Drawing Sheets

CENTRIFUGAL SLURRY PUMP IMPELLER SHROUD WITH LIP

TECHNICAL FIELD

This disclosure relates in general to a pump impeller for use in centrifugal pumps. More particularly, though not exclusively, to pumps for handling abrasive materials such as for example slurries and the like.

Various process steps in the minerals processing industry involve erosive contact with components of equipment which results in significant wear to the extent that frequent replacement is required. However, often the wear of a component is uneven depending on the nature of the process step.

For example, in the process of pumping abrasive slurries using a centrifugal slurry pump, a limiting factor on the centrifugal slurry pump wet end component wear life can be localised wear or very high wear rates in certain locations of the slurry pump liner or casing. In particular, it was identified that interaction of the centrifugal slurry pump impeller pumping vanes with the slurry, or fluid, gives rise to the formation of 'horseshoe' type vortices at the pressure side of the pumping vanes and in a similar way at the suction side of the pumping vanes. These vortices leave the centrifugal slurry pump impeller passageways and move around the pump casing in the form of an impeller wake. This wake causes erosion on the casing forming a 'twin vortices' like erosion pattern. In addition, it was identified that this wake affects the fluid entering the gap formed by the frame plate liner insert (also knowns as a back liner or drive side liner) and the impeller back shroud. As these vortices are strongest when leaving the impeller passageways, their action on the fluid entering the gap is strongest when the pumping fluid passes by the casing cutwater. This gives origin to a velocity enhanced area, which causes significant wear on the casing or liner at this location.

The various aspects disclosed herein may be applicable to all centrifugal slurry pumps and particularly to those that experience high wear rates on the liner or casing.

SUMMARY

According to one aspect there is provided a centrifugal slurry pump impeller including: a back shroud with opposed inner and outer faces and an outer peripheral edge, a central axis, a plurality of pumping vanes extending from the inner main face of the back shroud, the pumping vanes being disposed in spaced apart relation, each pumping vane including opposed main side faces, a leading edge in the region of the central axis and a trailing edge in the region of the outer peripheral edge of the back shroud with passageways between adjacent pumping vanes, wherein the inner main face of the back shroud along the length of the passageways, leading from the leading edge to the trailing edge, includes a generally planar inner region beginning adjacent the leading edge of the plurality of pumping vanes, and an outer region ending at the outer peripheral edge of the back shroud, wherein the outer region of the inner face of the back shroud includes a lip formation with an apex including a convex surface.

According to another aspect, there is provided a centrifugal slurry pump assembly including: an outer casing, an inner liner arranged within the outer casing, the inner liner including a main liner and two side liners which form a pumping chamber when assembled, an impeller mounted for rotation within the pumping chamber, the impeller including: a back shroud with opposed inner and outer faces and an outer peripheral edge, a central axis, a plurality of pumping vanes extending away from the inner main face of the back shroud, the pumping vanes being disposed in spaced apart relation, each pumping vane including opposed main side faces, a leading edge in the region of the central axis and a trailing edge in the region of the outer peripheral edge of the back shroud with passageways between adjacent pumping vanes, wherein the inner main face of the back shroud along the length of the passageways, leading from the leading edge to the trailing edge, includes a generally planar inner region beginning adjacent the leading edge of the plurality of pumping vanes and an outer region ending at the outer peripheral edge of the back shroud, wherein the outer region of the inner face of the back shroud includes a lip formation with an apex including a convex surface, and wherein the pumping chamber includes a void between the outer peripheral edge of the back shroud and an inner peripheral surface of the inner liner to provide for the circulation of fluid in the pumping chamber when in use In certain embodiments, the lip formation is located adjacent, or at the outer peripheral edge of the back shroud.

In certain embodiments, the surface of the inner region of the back shroud is in a plane which is perpendicular to the central axis.

In certain embodiments, the surface of the lip formation includes a transition region which blends with the surface of the inner region, wherein as the transition region moves away from the inner region, the transition region thickens in a direction away from the inner face of the back shroud.

In certain embodiments, the transition region begins after a midpoint along the length of the passageways. In a preferred form, the transition region begins after 75% of the length of the passageways. In a further preferred form, the transition region begins after 85% of the length of the passageways.

In certain embodiments, the transition region is in the form of a radius positioned tangent to the apex of the lip formation and tangent to the inner face of the back shroud.

In certain embodiments, the back shroud has a thickness between the inner face and the outer face of h, and the apex has a height from the inner face of the back shroud of about 0.3 h to about 0.5 h. In a further form, a length of the transition region and the lip formation is about 3 h to about 5 h. In yet a further form, a diameter of circle defining the convex surface of the apex is about 0.3 h to about 0.5 h.

In certain embodiments, the centrifugal slurry pump impeller further includes a front shroud with opposed inner and outer faces and an outer peripheral edge wherein the plurality of pumping vanes extend between the inner faces of the back shroud and the front shroud.

In certain embodiments, an inner region of the inner face of the front shroud located in the passageways is substantially planar, and is in a plane that is substantially perpendicular to the central axis.

In certain embodiments, an outer region of the inner face of the front shroud located in the passageways is substantially planar and is in a plane that is substantially perpendicular to the central axis.

Other aspects, features, and advantages will become apparent from the following detailed description when taken in conjunction with the accompanying drawings, which are a part of this disclosure and which illustrate, by way of example, principles of the inventions disclosed.

DESCRIPTION OF THE FIGURES

The accompanying drawings facilitate an understanding of the various embodiments.

FIG. 2. depicting the back shroud of the impeller in plan view;

FIG. 5;

DETAILED DESCRIPTION

Figure 1:
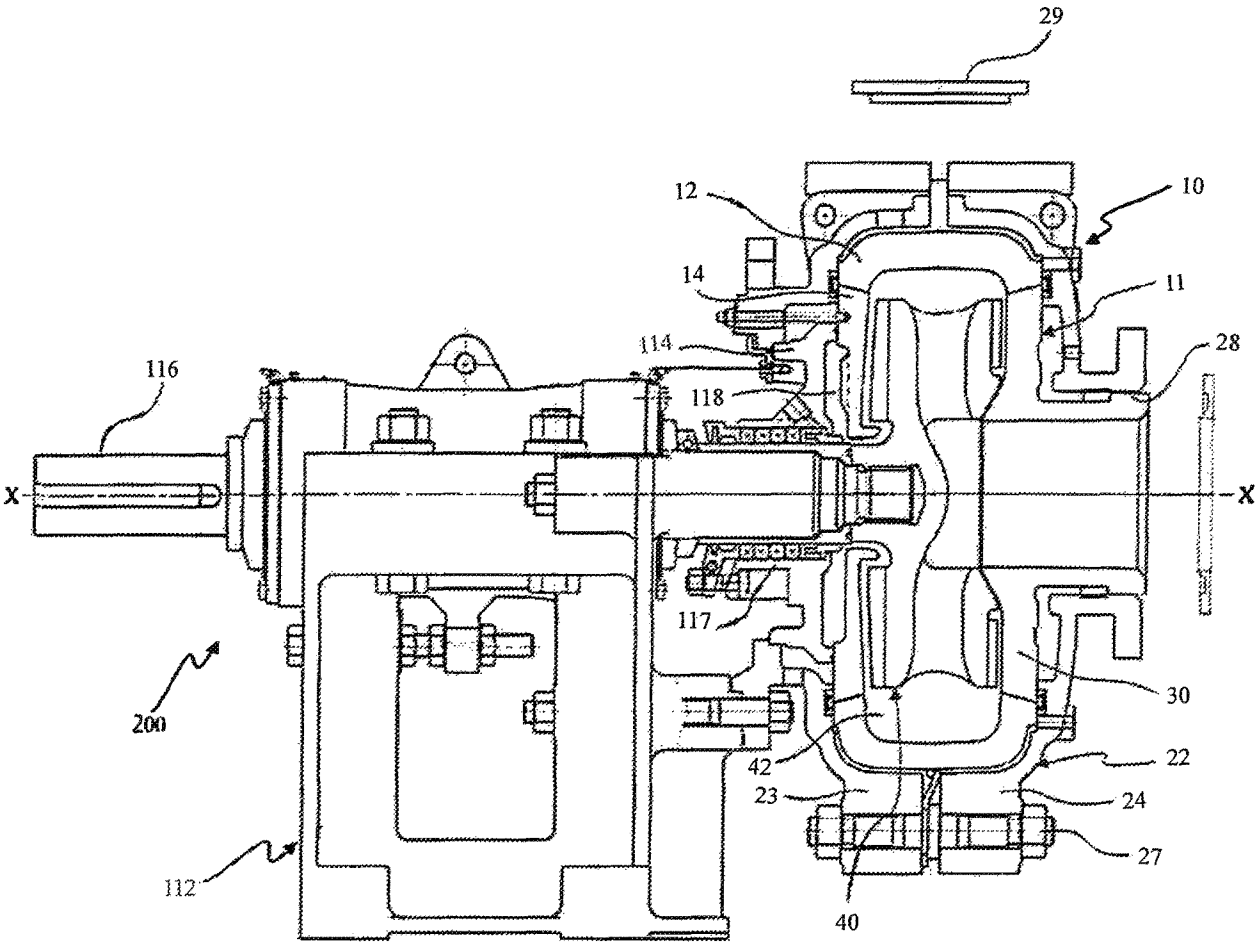
FIG. 1 (PRIOR ART)
FIG. 1 is a schematic partial cross-sectional side elevation of one form of a typical centrifugal pump apparatus.

Referring to FIG. 1 of the drawings, there is generally illustrated a pump apparatus 200 comprising a pump 10 and pump housing support in the form of a pedestal or base 112 to which the pump 10 is mounted. Pedestals are also referred to in the pump industry as frames. The pump 10 generally comprises an outer casing 22 that is formed from two side casing parts or sections 23, 24 (sometimes also known as the frame plate and the cover plate) which are joined together about the periphery of the two side casing sections 23, 24. The pump 10 is formed with side openings one of which is an inlet 28 there further being a discharge outlet 29 and, when in use in a process plant, the pump is connected by piping to the inlet 28 and to the outlet 29, for example to facilitate pumping of a mineral slurry.

The pump 10 further comprises a pump inner liner 11 arranged within the outer casing 22 and which includes a main liner 12 and two side liners 14, 30. The side liner 14 is located nearer the rear end of the pump 10 (that is, nearest to the pedestal or base 112), and the other side liner (or front liner) 30 is located nearer the front end of the pump and inlet hole 28. The side liner 14 is also referred to as the back side part or frame plate liner insert and the side liner 30 is also referred to as the front side part or throatbrush. The main liner 12 comprises two side openings therein.

The two side casing parts 23, 24 of the outer casing 22 are joined together by bolts 27 located about the periphery of the casing parts 23, 24 when the pump is assembled for use. In some embodiments the main liner 12 can also be comprised of two separate parts which are assembled within each of the side casing parts 23, 24 and brought together to form a single main liner, although in the example shown in FIG. 1 the main liner 12 is made in one-piece, shaped similar to a car tyre. The liner 11 may be made of materials such as rubber, elastomer or of metal.

When the pump is assembled, the side openings in the main liner 12 are filled by or receive the two side liners 14, 30 to form a continuously-lined pumping chamber 42 disposed within the pump outer casing 22. There is a space or void provided in the pumping chamber between the outer circumferential edge of the impeller 40 leading to the inner peripheral surface of the main liner 12 which allows the fluid pumped via the action of the impeller to circulate in the pumping chamber which then exits via the discharge outlet 29.

A seal chamber housing 114 encloses the side liner (frame plate liner insert, or back side part) 14 and is arranged to seal the space or chamber 118 between drive shaft 116 and the pedestal or base 112 to prevent leakage from the back area of the outer casing 22. The seal chamber housing takes the form of a circular disc section and an annular section with a central bore, and is known in one arrangement as a stuffing box 117. The stuffing box 117 is arranged adjacent to the side liner 14 and extends between the pedestal 112 and a shaft sleeve and packing that surrounds drive shaft 116.

Figure 2:
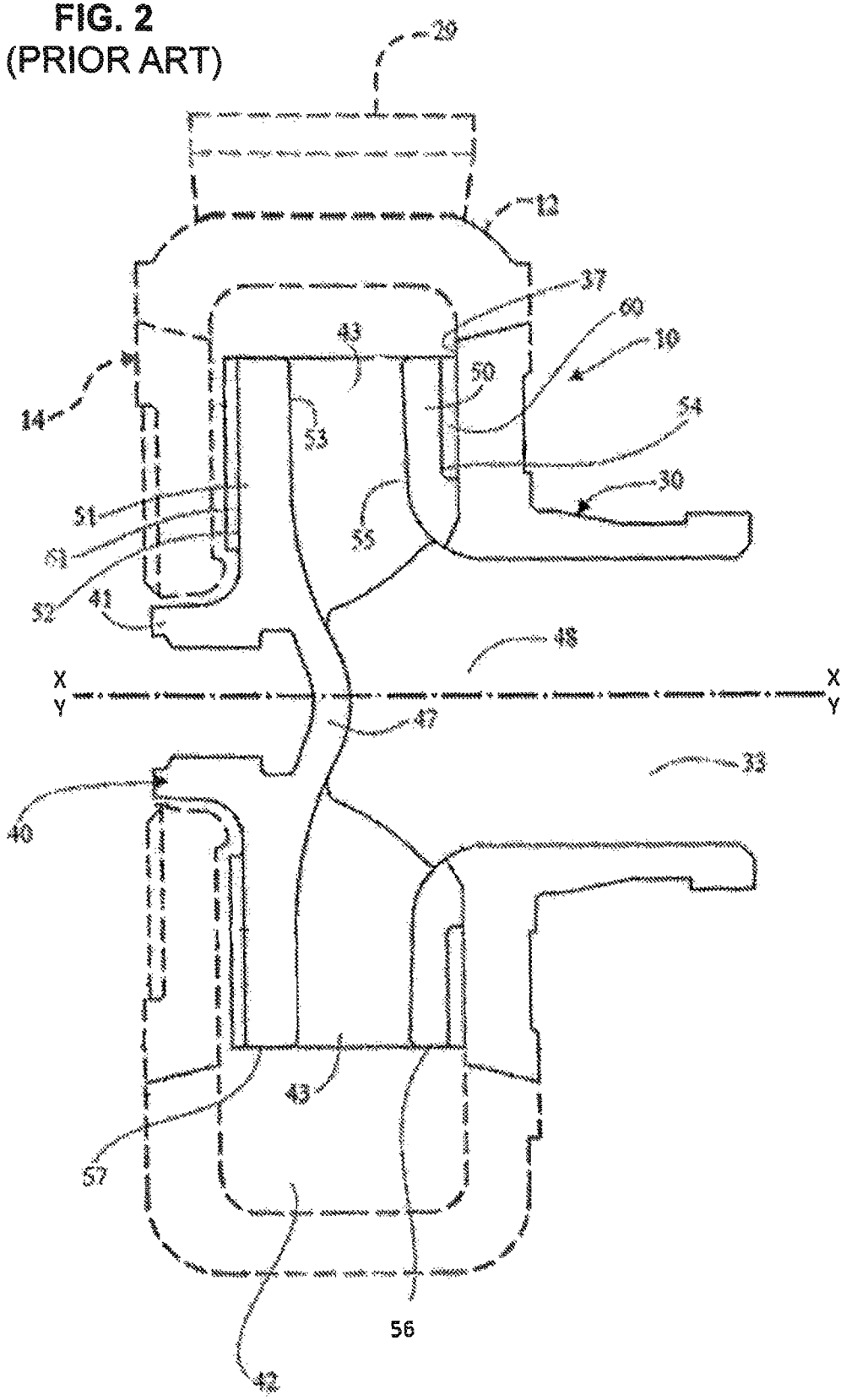
FIG. 2 (PRIOR ART)
FIG. 2 is a more detailed schematic partial cross-sectional side elevation of part of the centrifugal pump apparatus of FIG. 1.
Figure 3:
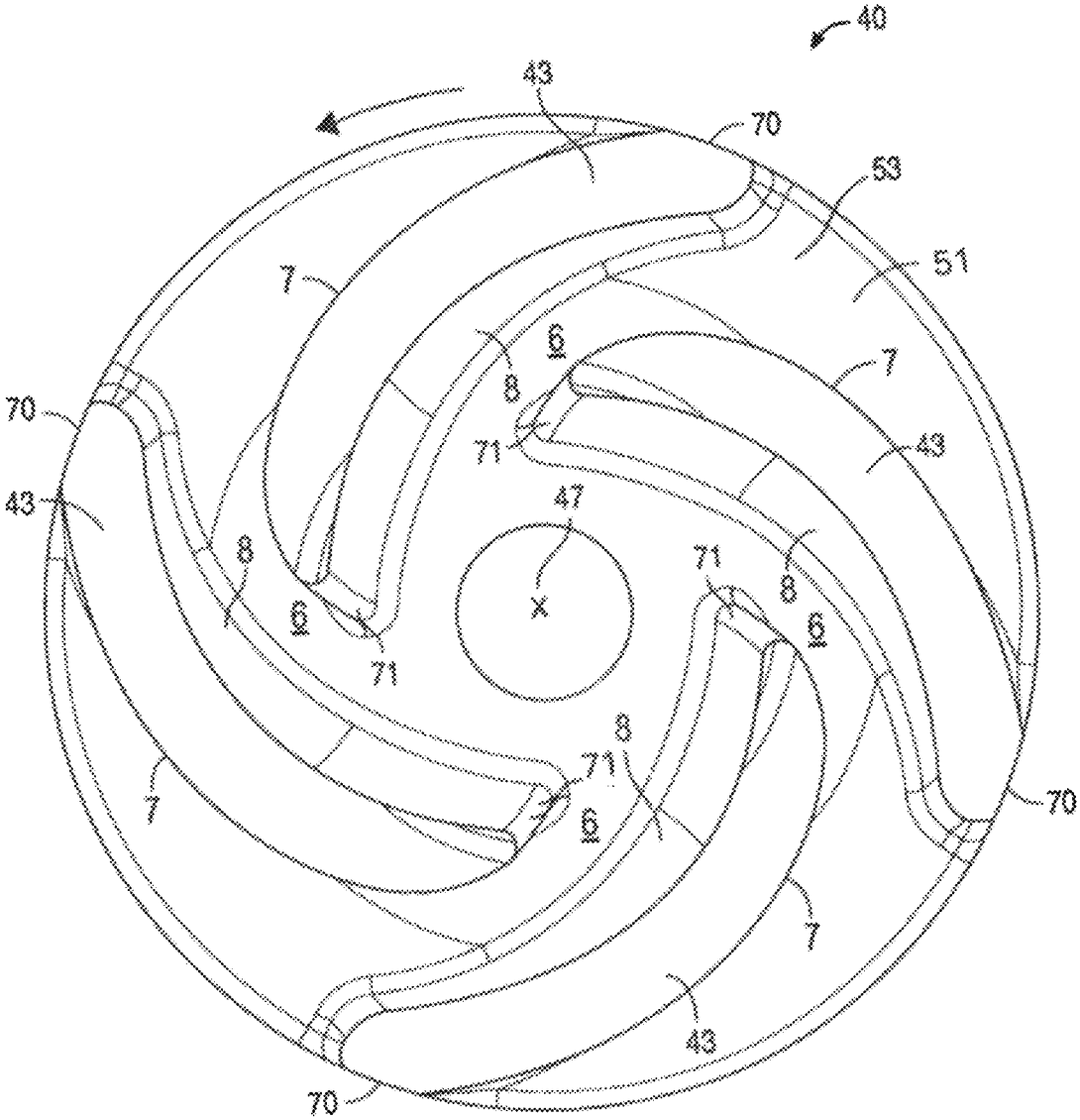
FIG. 3 (PRIOR ART)
FIG. 3 is a section view of a typical impeller for use in the pump apparatus of FIG. 1.

FIGS. 1, 2 and 3 show a typical and known impeller 40. In FIGS. 1 & 2, the impeller 40 is positioned within the main liner 12 and is mounted or operatively connected to the drive shaft 116 which is adapted to rotate about a rotation axis X-X, or central axis. A motor drive (not shown) is normally attached by pulleys to an exposed end of the shaft 116, in the region behind the pedestal or base 112. The rotation of the impeller 40 causes the fluid (or solid-liquid mixture) being pumped to pass from a pipe which is connected to the inlet 28 through the pumping chamber 42 which is within the main liner 12 and the side liners 14, 30 and then out of the pump via the discharge outlet 29.

The impeller 40 includes a hub 41 from which a plurality of circumferentially spaced pumping vanes 43 extend. A nose portion 47 extends forwardly from the hub 41 towards an impeller inlet 48 and an inlet passage 33 in the front liner 30. The impeller 40 further includes a front shroud 50 and a back shroud 51, the vanes 43 being disposed and extending therebetween and an impeller inlet 48.

The impeller front shroud 50 includes an inner face 55, an outer face 54 and a peripheral edge portion 56. The back shroud 51 includes an inner face 53, an outer face 52 and a peripheral edge portion 57. The front shroud 50 includes the inlet 48, being the impeller inlet and the vanes 43 extend between the inner faces of the shrouds 50, 51. The shrouds are generally circular or disc-shaped when viewed in elevation; that is in the direction of rotation axis X-X.

As illustrated in FIG. 2, each impeller shroud may have a plurality of auxiliary or expelling vanes on the outer faces 52, 54 thereof, there being a first group of auxiliary vanes 60 on the outer face 54 of the front shroud 50 and a second group of auxiliary vanes 61 on the outer face 52 of the back shroud 51. Auxiliary vanes are an optional feature of the impeller. The inner faces of the front and back shrouds are planar leading to the outer peripheral edge portion and the surface of the inner faces is generally in a place that is perpendicular to the rotation axis X-X.

Referring to FIG. 3 there is shown a cross-section of the centrifugal slurry pump impeller 40 shown in FIGS. 1 and 2 with the front shroud 50 not shown providing a plan view of the back shroud 51. The impeller 40 includes a back shroud 51 with four pumping vanes 43 extending from the back shroud 51 in a direction generally in line with an axis of rotation X of the slurry pump impeller 40 when in use which provides that the pump impeller 40 turns in a counter clockwise fashion as shown in FIG. 3. The inner face 55 of the back shroud 51 is axisymmetric and also generally in a plane which is at right angles to the axis of rotation X. The four pumping vanes 43 each include a trailing edge 70 and a leading edge 71, where the leading edge 71 of the pumping vanes is adjacent the centre, or nose 47 and inlet 48 of the impeller 40 where the slurry enters during operation of an associated centrifugal slurry pump (not shown). The slurry passes via the inlet 48, towards the nose 47 and then is moved due to the orientation and rotation of the slurry pump impeller through the four passageways 6 located between adjacent pumping vanes 43. The pumping vanes 43 further include opposed main side faces 7, 8. The opposed side faces include a pressure side face 7 also known as a pumping side face, and a suction side face 8. Each of the opposed main side faces 7, 8 define the passageways 6 together with the inner face of the back shroud 53, and the inner face of the front shroud 55 (not shown).

The location and function of the four passageways 6 means that this section of the slurry pump impeller 10 and particularly the area of the passageways 6 along the surfaces of the inner face of the back shroud 53 and the inner face of the front shroud 55 are the location of significant slurry flow. Typically, during operation there is a higher velocity on the suction side of the pumping vanes 43 adjacent the suction side face 8 and a lower velocity on the pressure, or pumping side face 7, of the pumping vane 43 near the leading edge. This differential in velocity leads to the formation of vortices adjacent the inner faces 53, 55 of the back and front shrouds 51, 50. Another type of known impeller is referred to as a semi-open impeller. A semi-open impeller includes just one back shroud and the pumping vanes extend from the back shroud towards the inlet of the centrifugal pump.

Figure 4:
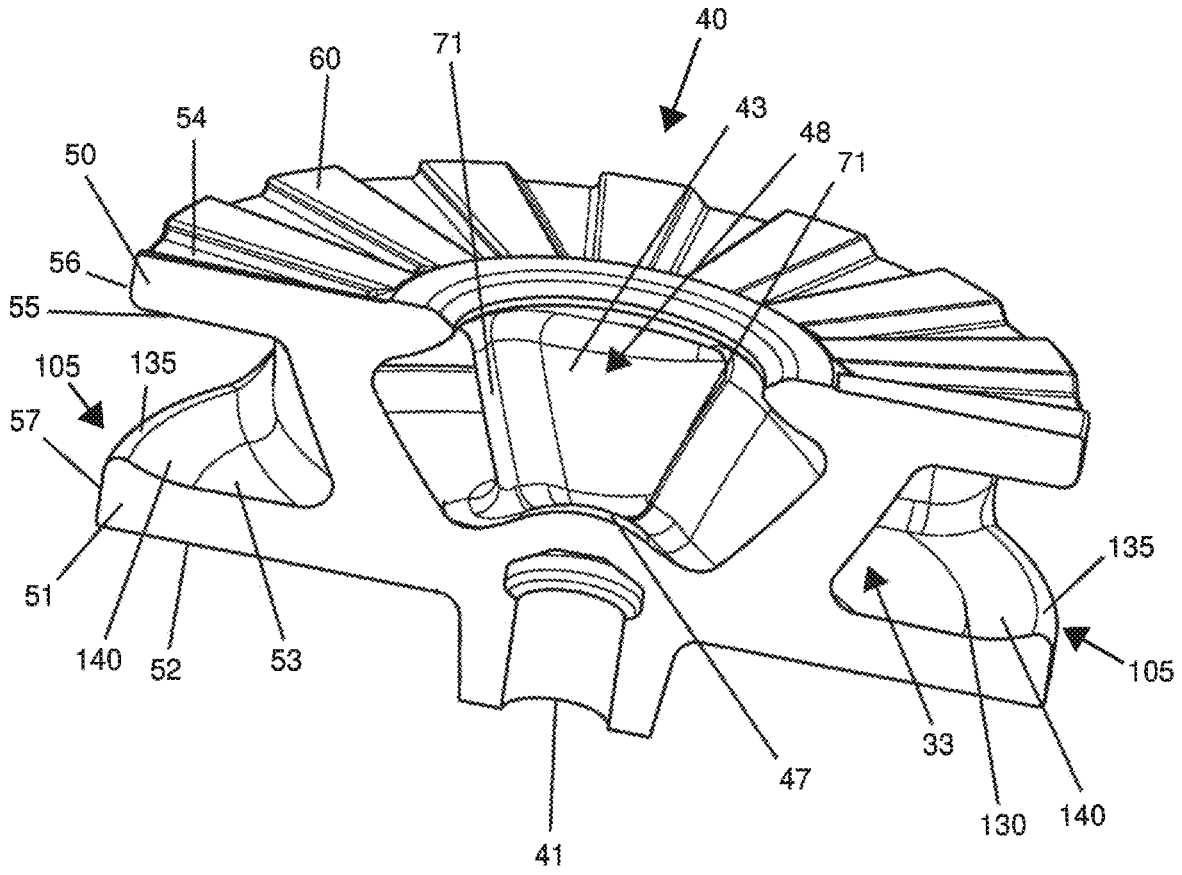
FIG. 4 is a sectional perspective view of an impeller in accordance with an embodiment of the present disclosure.
Figure 5:
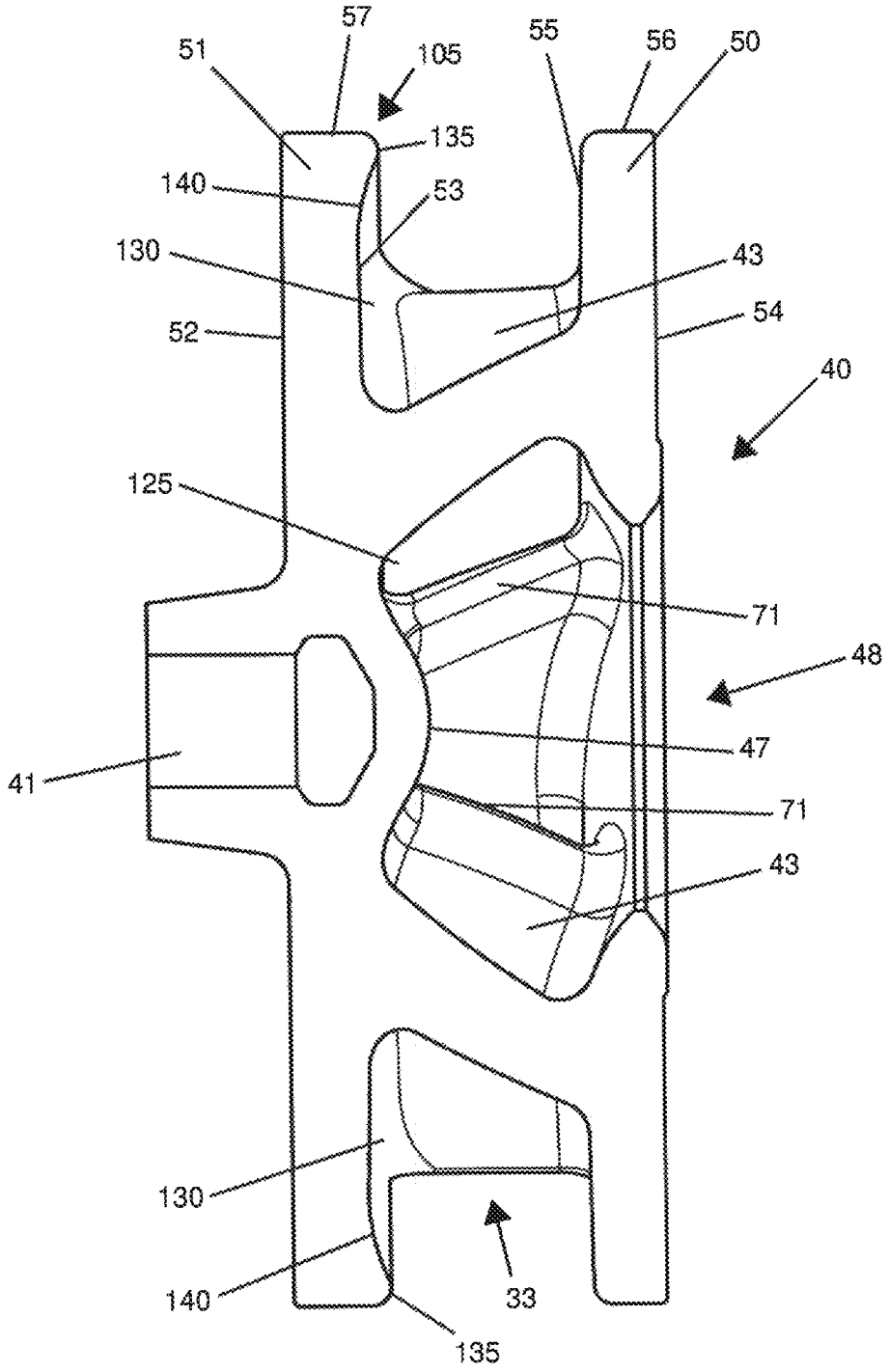
FIG. 5 is cross sectional side view of the impeller of FIG. 4.
Figure 6:
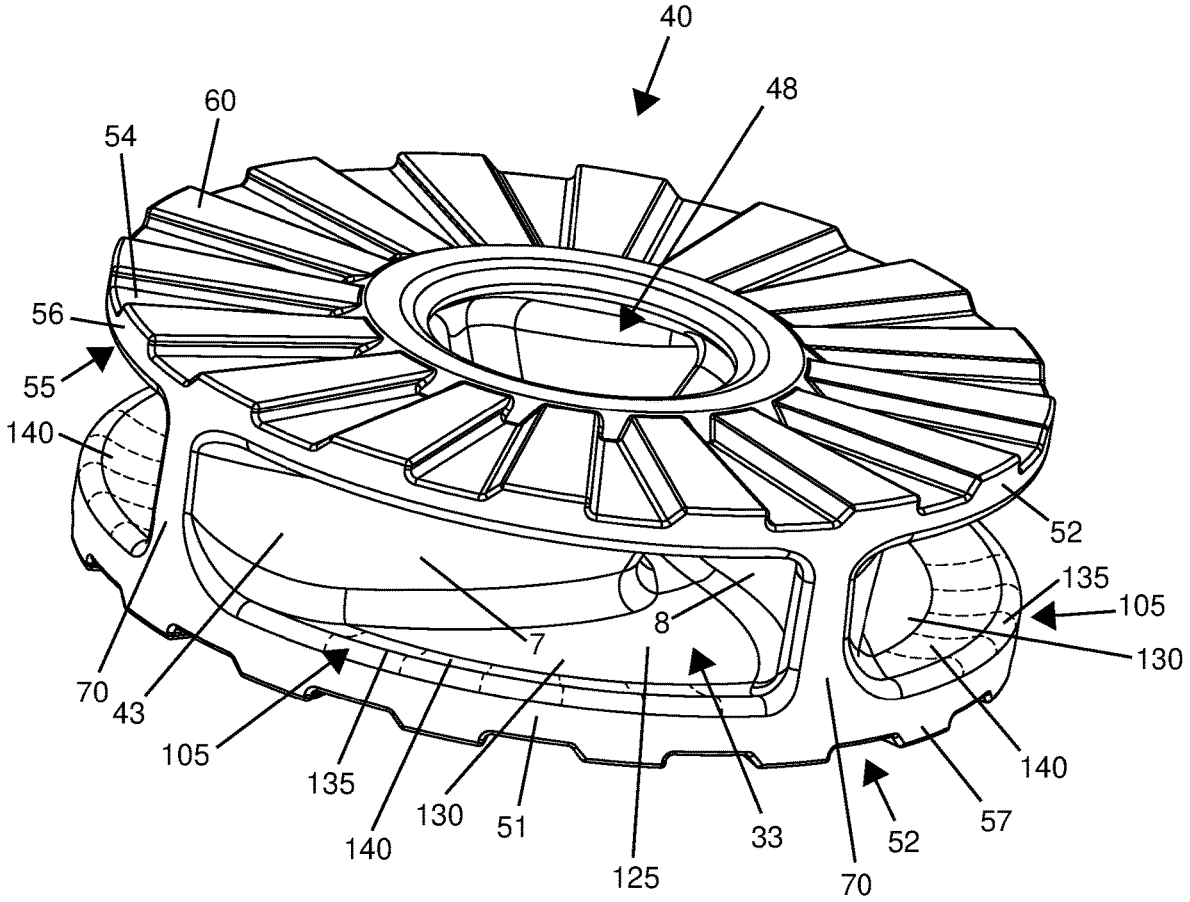
FIG. 6 is a perspective view of the impeller of FIG. 4.

In FIGS. 4 to 6 there is shown an embodiment of a centrifugal slurry pump impeller 40 in accordance with the present disclosure. The embodiment described depicts a "closed" impeller type, which is one that includes a back shroud and a front shroud with pumping vanes located therebetween. However, embodiments of the present disclosure may equally apply to the configuration of a semi-open impeller including a back shroud only.

Turning to FIGS. 4 to 6 the impeller 40 includes a back shroud 51 and a front shroud 50 each with opposed inner 53, 55 and outer faces 52, 54, an outer peripheral edge 57, 56 and a central axis. The central axis is in line with the location of the center of the hub 41 on the back shroud 51, the impeller nose 47 and a centre point of the inlet 48 of the front shroud 50.

The impeller 40 further includes a plurality of pumping vanes 43 extending between the inner main faces 53, 55 of the back and front shrouds 51, 50. The four pumping vanes 43 are disposed equally spaced from one another around the inner main faces 53, 55 of the back and front shrouds 51, 50 of the impeller 40. The pumping vanes 43 each include opposed main side faces 7, 8 a leading edge 71 in the region of the central axis and a trailing edge 70 in the region of the outer peripheral edges 57, 56 of the back and front shrouds 51, 50. The main side faces of the pumping vanes 43 include a pumping or pressure side face 7 and a suction side face 8.

A passageway 6 is located between each adjacent pumping vane 43. Each passageway 6 includes a blended region 110 located between each of the main side faces 7, 8 of the pumping vanes 43 and the inner faces 53, 55 of the front and back shrouds 50, 51. The blended regions act as a transition surface between the surface of the main side faces 7, 8 and the inner faces 53, 55 of the front and back shrouds 50, 51.

The inner main faces 53, 55 of the back and front shrouds 50, 51 along the length of the passageways 6 leading from the leading edge 71 to the outer peripheral edge 57, 56 include an inner region 125 which starts at the beginning of the passageways 6 adjacent the leading edge 71 of the plurality of pumping vanes 43, and also an outer region 130, which ends at the outer peripheral edge 56, 57 of the front and back shrouds 50, 51. The outer region 130 of the back shroud includes a lip formation 105 whereas the outer region of the front shroud in the embodiment shown does not include a lip formation 105. Rather the outer region of the inner face of the front shroud is substantially planar. The present disclosure also envisages embodiments where the front shroud of a closed impeller also includes a lip formation.

As is shown in FIGS. 4 to 6 and 8, the lip formation 105 is located on the outer region 130 of the inner main face 53 of the back shroud 51 and may be adjacent, or at the outer peripheral edge 57 of the back shroud 51. The lip formation extends along the outer region 130 adjacent, or at the outer peripheral edge 57, of the back shroud 51 from the trailing edge of one pumping vane 43 to the trailing edge of an adjacent pumping vane 43.

The surface of the inner region 125 located on the inner face 53 of back shroud 51 is generally planar and may also be generally in line with a plane that is perpendicular to the central axis.

The surface of the lip formation 105 includes a transition region 140 which blends with the planar surface of the inner region 125 of the back shroud 51. As the transition region 140 moves away from the inner region 125 in a direction towards the outer peripheral edge 57 of the back shroud 51, the transition region thickens. Otherwise stated, the back shroud thickens so that the inner face 53 of the back shroud 51 moves towards the inner face 55 of the front shroud 50. Alternatively, in the case of a semi-open impeller, the inner face of the back shroud moves towards the direction of the inlet when the impeller is installed in a centrifugal pump assembly.

The transition region continues to thicken as the inner face of the back shroud moves towards the outer peripheral edge 57 until reaching an apex 135 of the lip formation 105. At the location of the apex 135, the inner face 53 of the back shroud 51 is closer to the inner face 55 of the front shroud 50 than at the transition region 140 and the inner region 125.

The transition region 140 may begin after a midpoint along the length of the passageways 6. In a preferred form, the transition region 140 begins after 75% of the length of the passageways 6. In yet a further preferred form, the transition region 140 begins after 85% of the length of the passageways 6. The transition region 140 may also be in the form of a concave surface, whereas the apex 135 of the lip formation 105 is preferably rounded in the form of a convex surface in a radial direction from the central axis. Furthermore, the ramp or transition region 140 may be in the form of a radius positioned tangent to the apex of the lip formation 135 and tangent to the inner face 53 of the back shroud.

Figure 8:
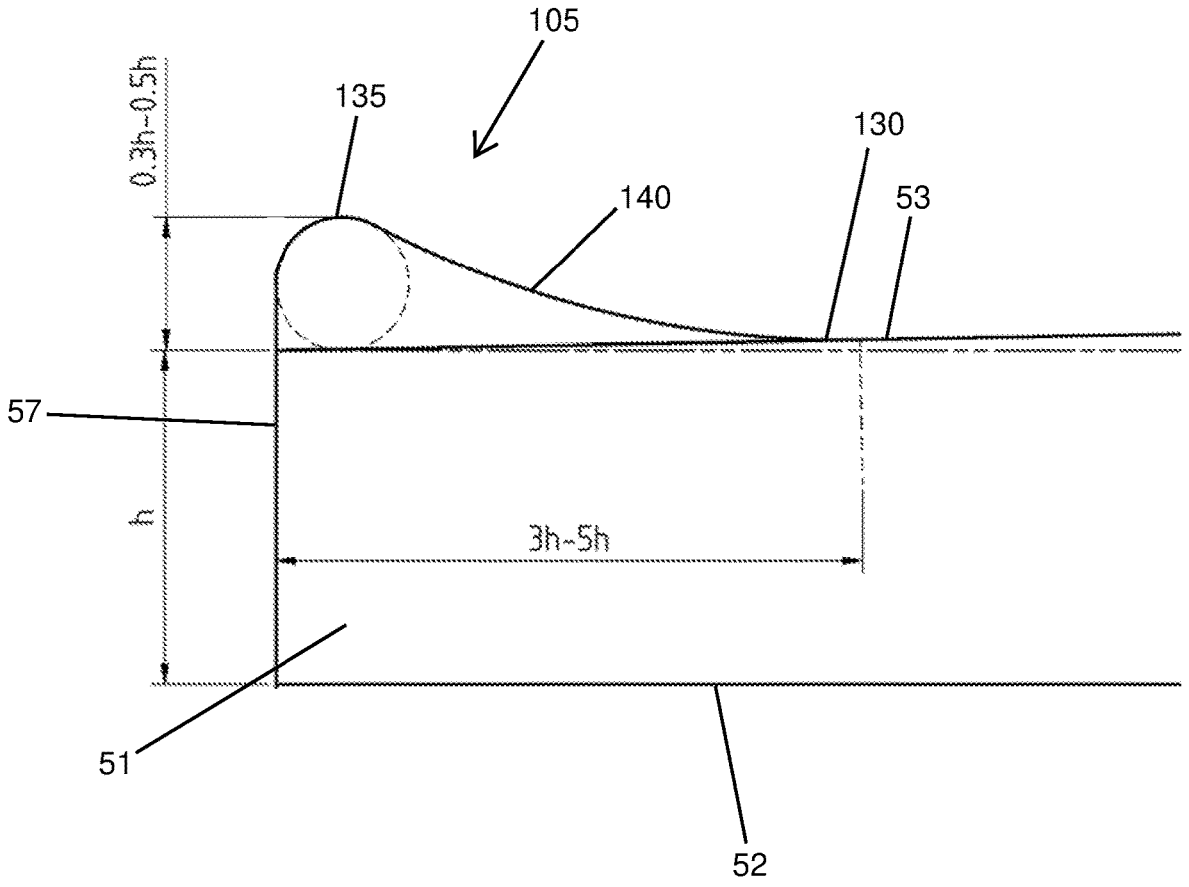

Referring specifically to the embodiment shown in FIG. 8, the relationship between the thickness of the back shroud 51, the length of the transition region 140 and lip formation 135, the height of the apex 135 from the inner face 53 of the back shroud 51 and the convex shape of the apex region may be expressed using the following relationships with reference to FIG. 8:

$$\text{Back Shroud thickness} = h$$

$$\text{Height of Apex} = 0.3h \text{ to } 0.5h$$

$$\text{Length of transition region} + \text{lip formation} = 3h \text{ to } 5h$$

$$\text{Diameter of circle including apex at the lip formation} = 0.3h \text{ to } 0.5h$$

The inner regions 125 of the front and back shrouds 50, 51 are substantially planar and may be in a plane that is substantially perpendicular to the central axis. The outer region of the front shroud 50 may also be substantially planar, and is generally in a plane that is perpendicular to the central axis.

As previously discussed herein, the interaction of the centrifugal slurry pump impeller pumping vanes with the slurry, or fluid, gives rise to the formation of 'horseshoe' type vortices at the pressure side of the pumping vanes and in a similar way at the suction side of the pumping vanes. These vortices leave the centrifugal slurry pump impeller passageways and move around the pump casing in the form of an impeller wake. This wake causes erosion on the casing forming a 'twin vortices' like erosion pattern and affects the fluid entering the gap formed by the back liner and the impeller back shroud. As these vortices are strongest when leaving the impeller passageways, their action on the fluid entering the gap is strongest when the pumping fluid passes by the casing cutwater. It was found that the lip formation 140 appearing on the outer region 130 of the back shroud 51 guides these vortices towards the center line of the casing in the pumping chamber, making the vortices weaker and therefore reducing their capacity of inducing velocity and causing erosive wear of the pump casing.

It was also found that including a lip formation with a convex or rounded surface at the apex provided reduced fluid flow separation at the peripheral edge of the back shroud. Flow separation, where part of the fluid stays attached to the inner surface of the back shroud, was also found to create a secondary group of vortices. By providing the convex or rounded surface at the apex of the lip formation, flow separation was significantly reduced enhancing the benefits of the lip formation for reducing localized wear during use.

Experimental Simulations

Figure 7A:
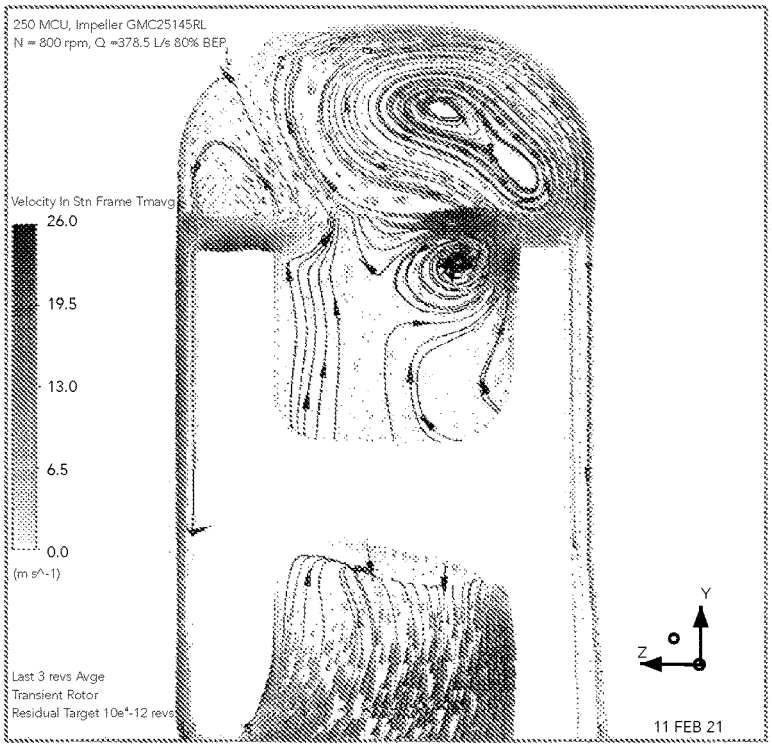
FIG. 7*a* is a graphic produced using computational fluid dynamics software showing the effect on the pumping fluid from an impeller in accordance with a prior art impeller.
Figure 7B:
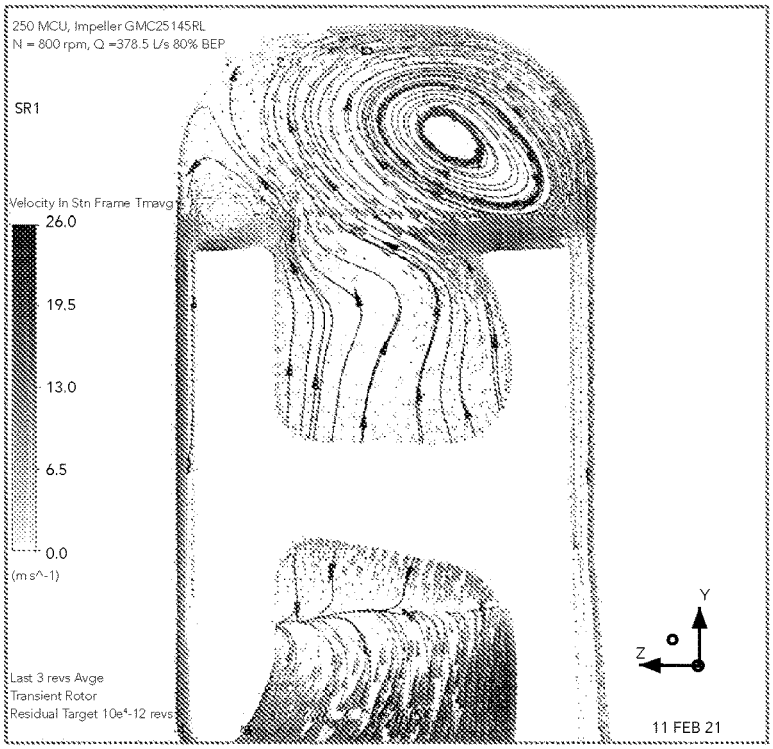
FIG. 7*b* is a graphic produced using computational fluid dynamics software showing the effect on the pumping fluid from an impeller in accordance with an embodiment of the present disclosure; and, FIG. 8 is a detailed sectional view of a back shroud of an impeller in accordance with an embodiment of the disclosure.

FIGS. 7*a* and 7*b* have been generated by computational fluid dynamics analysis using ANSYS CFX v19.0 software. FIG. 7*a* illustrates computer simulations of the velocity vectors created during operation of a prior art impeller similar in shape to that shown in FIG. 3. FIG. 7*b* illustrates computer simulations of the velocity vectors created during operation of an impeller in accordance with the present disclosure.

Referring to FIG. 7*b*. there can be seen an outward radial flow which is directed by the lip formation towards a center line of the casing which significantly dissipates the vortices formed in the passageways of the impeller during operation of the centrifugal slurry pump which may be compared to the prior art impeller of FIG. 7*a*.

The lip formation is shown to reduce the intensity of vortices leaving the impeller during operation. This reduces the vortex capacity of inducing velocities around it, in particular on the fluid entering the gap between the back liner and the back shroud of the impeller significantly reducing wear in these regions.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Terms such as "left" and right", "front" and "rear", "above" and "below" and the like are used as words of convenience to provide reference points and are not to be construed as limiting terms.

In this specification, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

In addition, the foregoing describes only some embodiments of the invention(s), and alterations, modifications, additions and/or changes can be made thereto without departing from the scope and spirit of the disclosed embodiments, the embodiments being illustrative and not restrictive.

Furthermore, invention(s) have described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention(s). Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

LIST OF PARTS

Pump Apparatus 200
Pump 10
Pedestal 112
Outer casing 22
Side casing parts 23, 24
Inlet 28
Discharge outlet 29
Inner liner 11
Main liner 12
Rear side liner 14
Front side liner 30
Pumping chamber 42
Bolts 27
Seal chamber housing 114
Seal space 118
Drive shaft 116
Stuffing box 117
passageways 6
pressure side face 7
suction side face 8
top surface 9
impeller 40
front shroud 50
back shroud 51
pumping vanes 43
trailing edge 70
leading edge 71
Inner face of front shroud 55
Outer face of front shroud 54
Peripheral edge portion of front shroud 56
Inner face of back shroud 53
Outer face of back shroud 52
Peripheral edge portion of back shroud 57
Hub 41
Impeller nose 47
Impeller inlet 48
Passage 33
Lip formation 105
Auxiliary vanes 60, 61

Inner region of passageway 125
Outer region of passageway 130
Apex of the lip formation 135
Transition region 140

The invention claimed is:

1. A centrifugal slurry pump impeller including:

a back shroud and a front shroud each with opposed inner and outer faces and an outer peripheral edge, a central axis, a plurality of pumping vanes extending between the inner faces of the back and front shrouds, the pumping vanes being disposed in spaced apart relation, each pumping vane including opposed main side faces, a leading edge in a region of the central axis and a trailing edge in a region of the outer peripheral edges of the back and front shrouds with passageways between adjacent pumping vanes, wherein the inner faces of the back and front shrouds along a length of the passageways, leading from the leading edges to the trailing edges, includes a planar inner region beginning adjacent the leading edges of the plurality of pumping vanes, and an outer region ending at the outer peripheral edge of the back shroud, wherein the outer region of the inner face of the back shroud includes a lip formation with an apex including a convex surface, and the outer region of the inner face of the front shroud is substantially planar and is in a plane that is substantially perpendicular to the central axis.

2. The centrifugal slurry pump impeller according to claim 1, wherein the lip formation is located adjacent, or at the outer peripheral edge of, the back shroud.

3. The centrifugal slurry pump impeller according to claim 1, wherein a surface of the inner region of the back shroud is in a plane which is perpendicular to the central axis.

4. The centrifugal slurry pump impeller according to claim 1, wherein a surface of the lip formation includes a transition region which blends with a surface of the inner region of the back shroud, wherein as the transition region moves away from the inner region of the back shroud, the transition region thickens in a direction away from the inner face of the back shroud.

5. The centrifugal slurry pump impeller according to claim 4, wherein the transition region begins after a midpoint along the lengths of the passageways.

6. The centrifugal slurry pump impeller according to claim 4 wherein the transition region is in the form of a radius positioned tangent to the apex of the lip formation and tangent to the inner face of the back shroud.

7. The centrifugal slurry pump impeller according to claim 4 wherein the back shroud has a thickness h between the inner face and the outer face, and a length of the transition region and the lip formation is 3 h to 5 h.

8. The centrifugal slurry pump impeller according to claim 4 wherein the back shroud has a thickness h between the inner face and the outer face, and a diameter of a circle defining the convex surface of the apex is 0.3 h to 0.5 h.

9. The centrifugal slurry pump impeller according to claim 4 wherein the transition region is in the form of a concave surface.

10. The centrifugal slurry pump impeller according to claim 1 wherein the back shroud has a thickness h between the inner face and the outer face, and the apex has a height from the inner face of the back shroud of 0.3 h to 0.5 h.

11. A centrifugal slurry pump assembly including: an outer casing, an inner liner arranged within the outer casing, the inner liner including a main liner and two side liners which form a pumping chamber, an impeller mounted for rotation within the pumping chamber, the impeller including: a back shroud and a front shroud each with opposed inner and outer faces and an outer peripheral edge, a central axis, a plurality of pumping vanes extending between the inner faces of the back and front shrouds, the pumping vanes being disposed in spaced apart relation, each pumping vane including opposed main side faces, a leading edge in a region of the central axis and a trailing edge in a region of the outer peripheral edge of the back and front shrouds with passageways between adjacent pumping vanes, wherein the inner faces of the back and front shrouds along a length of the passageways, leading from the leading edges to the trailing edges, includes a planar inner region beginning adjacent the leading edges of the plurality of pumping vanes and an outer region ending at the outer peripheral edge of the back shroud, wherein the outer region of the inner face of the back shroud includes a lip formation with an apex including a convex surface, and the outer region of the inner face of the front shroud is substantially planar and is in a plane that is substantially perpendicular to the central axis, and wherein the pumping chamber includes a void between the outer peripheral edge of the back and front shrouds and an inner peripheral surface of the inner liner to provide for the circulation of fluid in the pumping chamber when in use.

12. The centrifugal slurry pump assembly according to claim 11, wherein the lip formation is located adjacent, or at the outer peripheral edge of, the back shroud.

13. The centrifugal slurry pump assembly according to claim 11, wherein a surface of the inner region of the back shroud is in a plane which is perpendicular to the central axis.

14. The centrifugal slurry pump assembly according to claim 11, wherein a surface of the lip formation includes a transition region which blends with a surface of the inner region of the back shroud, wherein as the transition region moves away from the inner region of the back shroud, the transition region thickens in a direction away from the inner face of the back shroud.

15. The centrifugal slurry pump assembly according to claim 14, wherein the transition region begins after a midpoint along the lengths of the passageways.

16. The centrifugal slurry pump assembly according to claim 14 wherein the transition region is in the form of a radius positioned tangent to the apex of the lip formation and tangent to the inner face of the back shroud.

17. The centrifugal slurry pump assembly according to claim 11 wherein the back shroud has a thickness h between the inner face and the outer face, and the apex has a height from the inner face of the back shroud of 0.3 h to 0.5 h.

18. The centrifugal slurry pump assembly according to claim 11 wherein the back shroud has a thickness h between the inner face and the outer face, and a length of the transition region and the lip formation is 3 h to 5 h.

19. The centrifugal slurry pump assembly according to claim 15 wherein the back shroud has a thickness h between the inner face and the outer face, and a diameter of a circle defining the convex surface of the apex is 0.3 h to 0.5 h.

* * * * *